United States Patent [19]

Moulds

[11] 3,953,549

[45] Apr. 27, 1976

[54] FUEL METERING ROD POSITIONING MEANS

[75] Inventor: John W. Moulds, Penfield, N.Y.

[73] Assignee: General Motors Corporation, Detroit, Mich.

[22] Filed: Dec. 9, 1974

[21] Appl. No.: 530,829

[52] U.S. Cl. ..... 261/50 A; 261/71; 261/DIG. 38; 251/205; 251/279; 251/DIG. 4

[51] Int. Cl.[2] ..... F02M 7/22

[58] Field of Search ..... 261/50 A, 71, DIG. 38; 251/DIG. 4, 205, 279

[56] References Cited

UNITED STATES PATENTS

| | | | |
|---|---|---|---|
| 2,099,553 | 11/1937 | Atkins | 261/50 A |
| 2,956,791 | 10/1960 | Johnson | 261/50 A |
| 2,996,051 | 8/1961 | Mick | 261/50 A |
| 3,053,240 | 9/1962 | Mick | 261/50 A |
| 3,869,528 | 3/1975 | Mick | 261/50 A |
| 3,882,206 | 5/1975 | Gural et al. | 261/50 A |

*Primary Examiner*—Tim R. Miles
*Attorney, Agent, or Firm*—Robert M. Sigler

[57] ABSTRACT

In a carburetor having a fuel metering rod longitudinally movable through a fuel supply orifice with a lower end laterally movable to a limited degree, a positioning link connected to the lower end positions the metering rod according to fuel demand. An adjusting lever is pivotable with respect to the housing and includes an adjusting screw to set its position. An adjusting link connecting the adjusting lever to the lower end of the metering rod causes the position of the metering rod to be changed independently of fuel demand according to the position of the adjusting screw and lever.

1 Claim, 6 Drawing Figures

FUEL METERING ROD POSITIONING MEANS

SUMMARY OF THE INVENTION

This invention relates to fuel metering means such as the fuel metering rod disclosed in U.S. Pat. No. 3,882,206 to Gural et al., hereby incorporated by reference; and particularly to means for adjusting the position of such a metering rod to establish a base or reference fuel flow.

An air valve carburetor, as described in the reference application, includes fuel metering means interconnected with additional apparatus which controls the fuel metering means to dispense fuel to engine intake air at an appropriate rate. The fuel metering means generally includes a fuel metering rod of varying cross section longitudinally movable through an orifice by a positioning link attached to the control apparatus.

Means are desirable, however, for providing an adjustment mechanism to set the base or reference position of the metering rod. This invention provides such a mechanism for the air valve carburetor of the reference application which is simple and reliable and requires a minimum of change to the carburetor as previously disclosed.

This is accomplished by adding an adjusting link connecting the metering rod with a screw-adjusted lever in the carburetor housing. The metering rod is thus connected at its lower end to two links, each of which extends in a direction different from that of the metering rod and the other link. The result is that either link can move the lower end of the metering rod through an arc determined by the other link; and either link can thus change the longitudinal position of the metering rod within the opening.

Further details and advantages of this invention will be apparent in the accompanying drawings and following description of a preferred embodiment.

DESCRIPTION OF THE PREFERRED EMBODIMENT

Figure 1:
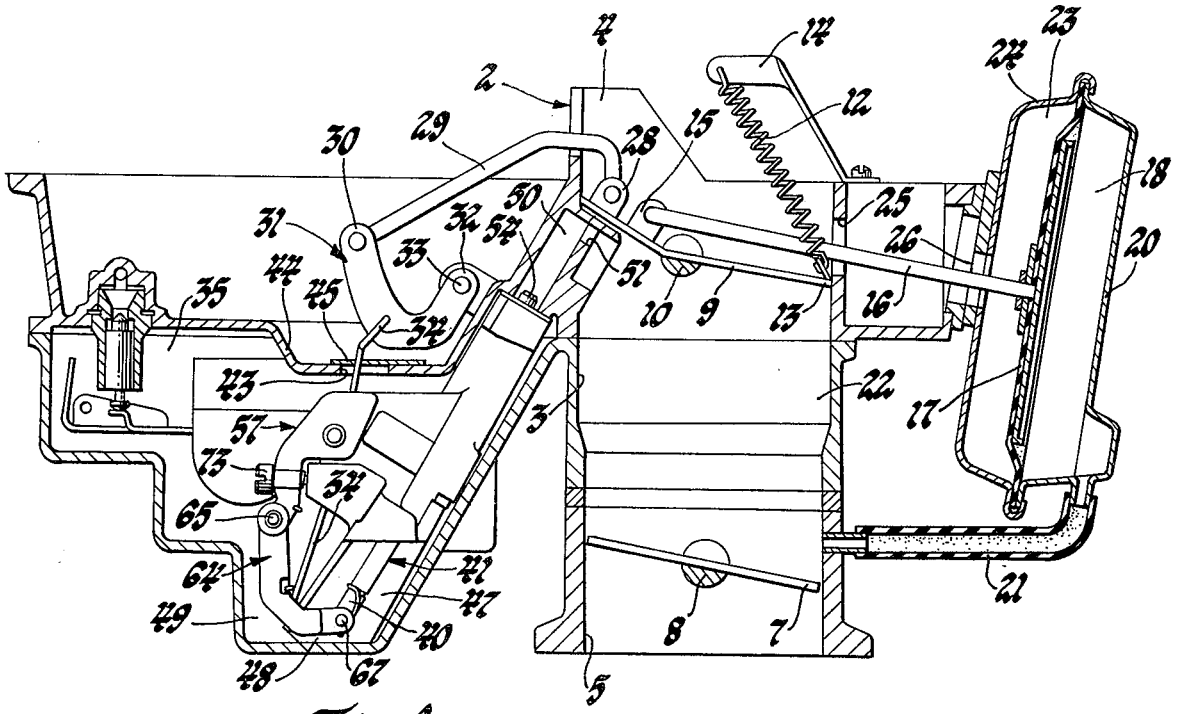
FIG. 1 is a cutaway view of a carburetor including this invention.

Referring to FIG. 1, a carburetor 2 has a mixture conduit 3 including an air inlet 4 and a mixture outlet 5 which discharges to an engine, not shown. A throttle 7 is disposed in mixture outlet 5 in the usual manner on a throttle shaft 8.

An air valve 9 is disposed in air inlet 4 on an air valve shaft 10. A spring 12 is hooked over the downstream edge 13 of air valve 9 or otherwise attached thereto and extends to a bracket 14 to bias air valve 9 to the position shown.

A tang 15 reaches upwardly from air valve 9 and is connected by a link 16 to a diaphragm 17. A chamber 18, formed between the right side of diaphragm 17 and a cover member 20, is connected by a tube 21 to a region 22 of mixture conduit 3 defined between air valve 9 and throttle 7.

A chamber 23, defined between the left side of diaphragm 17 and a cover member 24, is subjected to substantially atmospheric pressure, present in the air inlet 4, through openings such as 25 and 26.

In operation, chamber 18 is subjected to the subatmospheric pressure created in region 22 as throttle 7 is opened, and diaphragm 17 acts through link 16 to pull air valve 9 clockwise to an open position. Spring 12 is effective to balance the opening force of diaphragm 17, thereby creating a substantially constant subatmospheric pressure in region 22. By thus establishing a generally constant pressure drop across air valve 9, the area about air valve 9 and thus the rotative position of air valve 9 is determined by and is a measure of the rate of air flow through mixture conduit 3.

A tab 28 extends upwardly from air valve 9 and is connected through a link 29 to one end 30 of a lever 31. The opposite end 32 of lever 31 is pivoted about a pin 33. Between ends 30 and 32, a positioning link 34 extends from lever 31 into the carburetor fuel bowl 35. The lower end 37 of positioning link 34 has a hook 38, seen more clearly in FIGS. 2 and 3, which fits in a slot 39 formed in the lower end 40 of a metering rod 41 and is pivotally attached to a pin 42 which extends across slot 39.

It may be noted that the positioning link 34 extends through an opening 43 in the cover 44 of fuel bowl 35. Opening 43 is closed by a slider 45 which shifts horizontally during movement of positioning link 34.

Metering rod 41 is disposed in a fuel passage 47 having a lower end 48 disposed to receive fuel from a well 49 formed in the bottom of fuel bowl 35. The upper end 50 of fuel supply passage 47 has an opening 51 through which fuel is discharged into region 22 of mixture conduit 3. It will be appreciated, therefore, that the fuel in fuel bowl 35 is subjected to a substantially constant metering head; from the substantially atmospheric pressure in the upper portion of the fuel bowl to the generally constant pressure in region 22.

Figure 2:
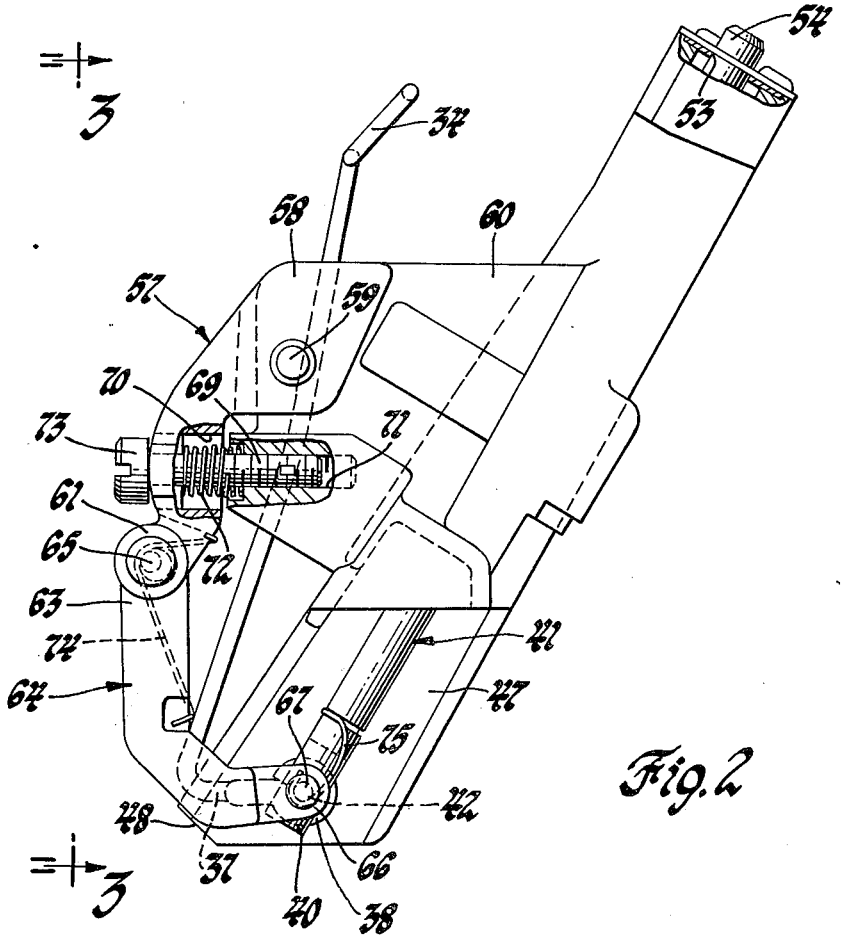
FIG. 2 is an enlarged view of a portion of FIG. 1 showing an embodiment of this invention.
Figure 3:
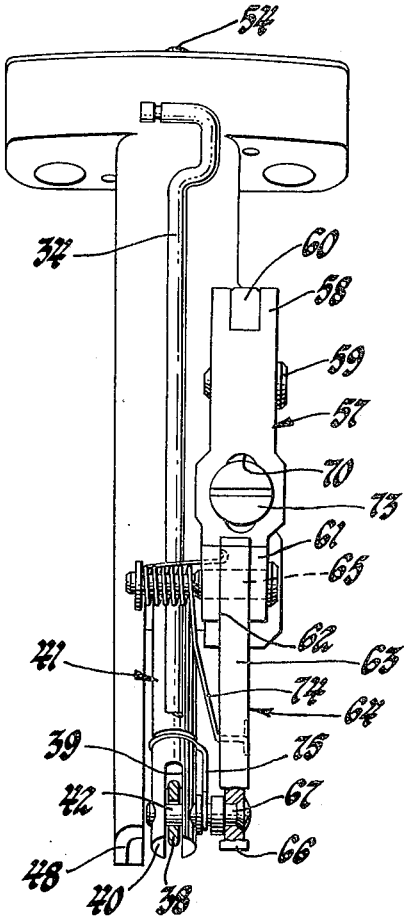
FIG. 3 is a view along lines 3—3 in FIG. 2.
Figure 4:
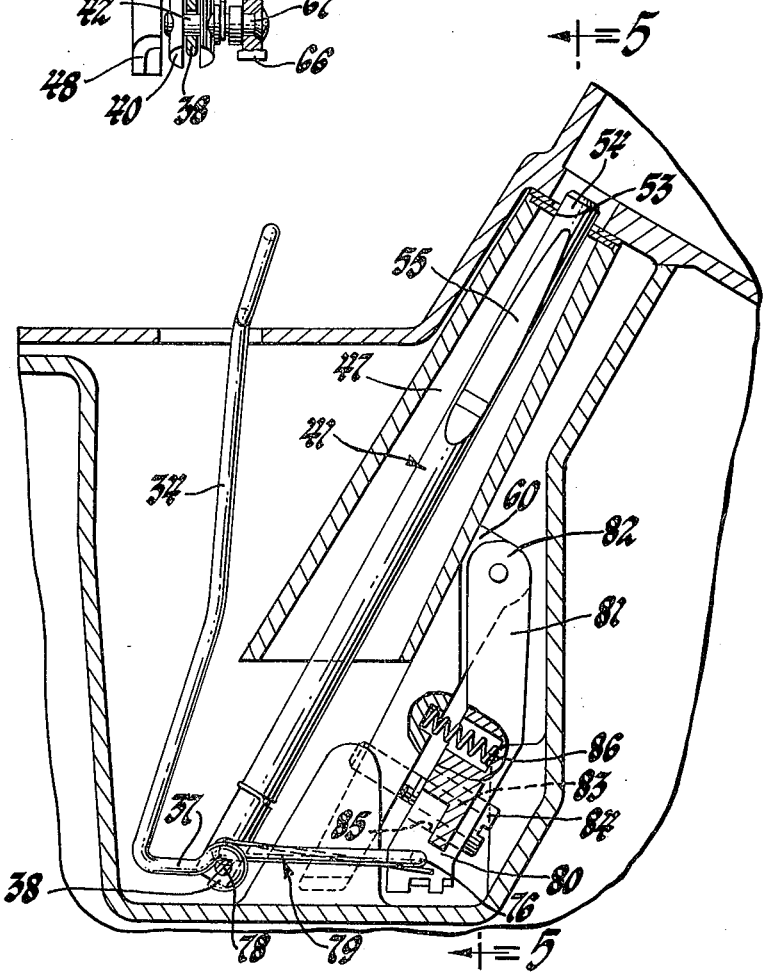
FIG. 4 shows an alternate embodiment of this invention.

As shown in FIG. 2, a metering jet or orifice 53 is disposed at the upper end of fuel supply passage 47 around the upper end 54 of metering rod 41 near opening 51. Metering rod 41 is provided with flat tapered surfaces 55, as shown in FIG. 4 and the reference application on opposite sides which, upon reciprocation of metering rod 41 in orifice 53, varies the area available for fuel through orifice 53.

An adjusting lever 57 has one end 58 attached pivotally about a pin 59 projecting from the housing 60 defining fuel supply passage 47. The other end 61 of lever 57 defines a slot 62; and one end 63 of an adjusting link 64 is pivotally attached to a pin 65 spanning slot 62. The other end 66 of adjusting link 64 is pivotally attached to an extension 67 of pin 42, which is attached to the lower end 40 of metering rod 41.

An adjusting screw 69 projects through an opening 70 in adjusting lever 57 between ends 58 and 61 and is received in a threaded opening 71 in housing 60. A spring 72 in opening 70 biases adjusting lever 57 away from housing 60 against the head 73 of adjusting screw 69 to take up any slack in the adjusting mechanism and position lever 57 definitely according to the position of adjusting screw 69.

It will be noticed, from FIGS. 1 and 2, that fuel supply passage 47 spreads slightly outward as it descends to its lower end 48. Thus the lower end 40 of metering rod 41 is free to move laterally through a limited range as well as longitudinally.

In operation, with end 61 of adjusting lever 57 fixed, the lower end 40 of metering rod 41 is constrained by adjusting link 64 to move in an arc about pin 65, the radius of which arc is the distance between pins 65 and 42. As air valve 9 opens by clockwise rotation, link 29 rotates lever 31 in a clockwise direction. Lever 31 then lifts positioning link 34 to move metering rod 41 generally upwardly and rightwardly in fuel supply passage 47, lower end 40 of metering rod 41 moving through the arc determined by adjusting link 64 as previously described. Thus as air valve 9 is opened to increase the area available for air flow through air inlet 4, metering rod 41 is shifted to increase the area available for fuel flow through metering orifice 53. Similarly, as air valve 9 closes by counterclockwise rotation, link 29 and lever 31 force positioning link 34 downward to move metering rod 41 generally downwardly and leftwardly in fuel supply passage 47. By this means, a substantially constant air-fuel ratio may be maintained; the precise proportion being controlled by the geometry of tapered surfaces 55 and of the linkage between air valve 9 and metering rod 41. An additional spring 74 between lever 57 and link 64 around pin 65 and another spring 75 around metering rod 41 and pin 42 take up slack in the adjusting linkage.

Figure 5:
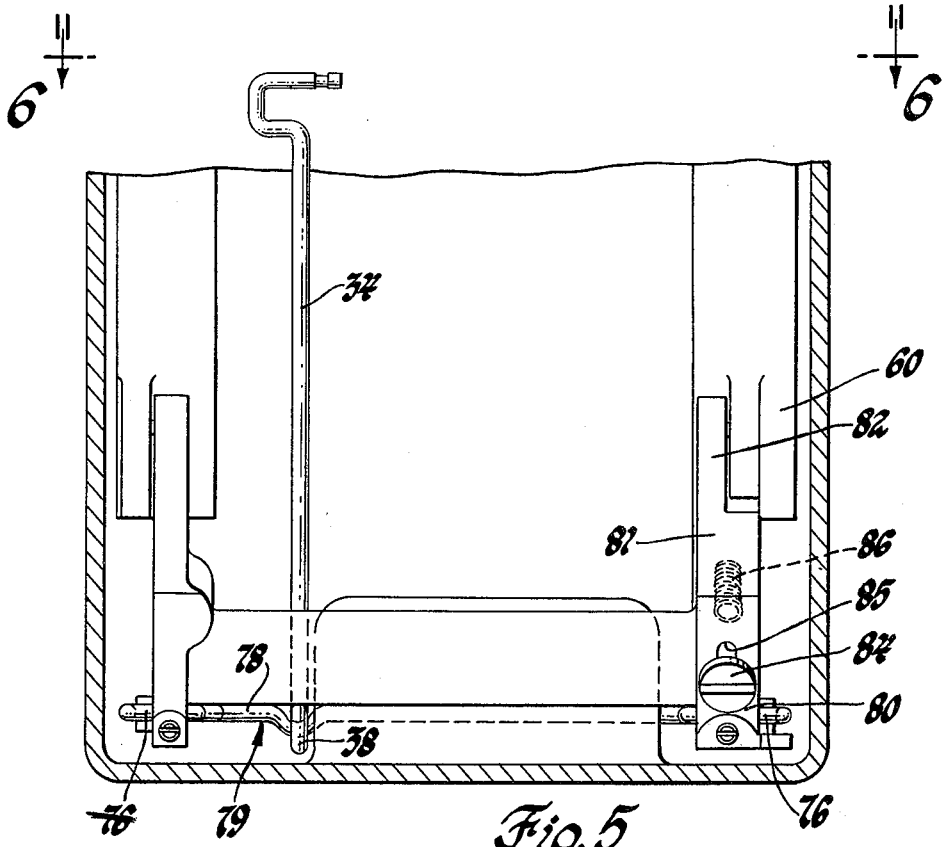
FIG. 5 is a view along lines 5—5 in FIG. 4.
Figure 6:
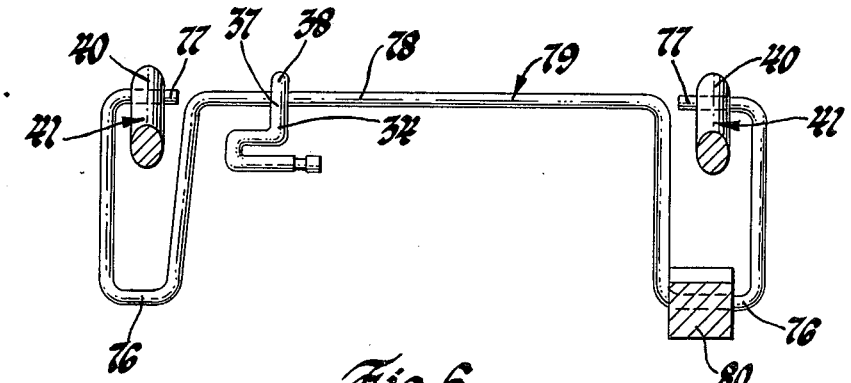
FIG. 6 is a view along lines 6—6 in FIG. 5.

The above described embodiment of this invention is appropriate for a carburetor with a single mixture conduit; however, with slight variations, this invention can also be applied to carburetors with more than one mixture conduit and metering rod. FIGS. 4 through 6 show a preferred embodiment for a carburetor with two fuel metering assemblies.

Referring to FIGS. 4 through 6, a pair of fuel metering rods 41 in fuel supply passages 47 have upper end 54 projecting through metering orifices 53 similarly to the arrangement shown in FIG. 2. A coordinating link 79 has a pair of pivot portions 76. Coordinating link 79 also includes, radially separated from pivot portions 76, a pair of ends 77, one of which is pivotally attached to the lower end 40 of each metering rod 41, and a central portion 78 to which is attached the lower end 37 of positioning link 34. Central portion 78 is generally aligned with ends 77 so that movement of positioning rod 34 causes corresponding movement of metering rods 41.

At least one pivot portion 76 is pivotally connected to the lower end 80 of an adjusting lever 81, the upper end 82 of which is pivotally connected to housing 60. An adjusting screw 83 with a head 84 projects through an opening 85 in adjusting lever 81 and is threadably received in housing 60. A spring 86 between adjusting lever 81 and housing 60 biases adjusting lever 81 against screw head 84; while another spring 87 contacting or encircling adjusting lever 81, coordinating link 79 and metering rod 41 takes up any slack in the mechanism.

The operation of this embodiment is similar to that of the first embodiment, with the exception that coordinating link 79 causes both metering rods 41 to move in unison according to positioning link 34 and adjusting lever 81. With adjusting lever 81 fixed, positioning link 34 causes the central portion 78 of coordinating link 79 to rotate in an arc about pivot portions 76; and the ends 77 follow central portion 78 to move the lower ends 40 of metering rods 41 through similar arcs and cause upper ends 54 of metering rods 41 to move reciprocally in metering orifice 53. The position of adjusting lever 81 can be adjusted by means of screw 83 to cause longitudinal movement of metering rods 43 in paths constrained by positioning link 34 and thereby change the base or reference positions of metering rods 41 simultaneously.

It will be appreciated by those skilled in the art that the principles shown in the above described embodiments can be applied to any number of fuel metering rods in a variety of arrangements. All these equivalents are considered within the scope of this invention, which should be limited only by the claims which follow.

The embodiments of the invention in which an exclusive property or privilege is claimed are defined as follows:

1. Engine fuel metering means comprising, in combination: a housing defining a fuel supply passage and a metering orifice opening therefrom; a metering rod having an upper end longitudinally movable in the metering orifice and a lower end longitudinally and laterally movable in the fuel supply passage; a positioning link pivotally attached for movement with the lower end of the metering rod; an adjusting lever pivotally mounted on the housing; an adjusting link pivotally connected between the adjusting lever and the lower end of the metering rod, whereby movement of the adjusting lever causes the lower end of the metering rod to move through a path constrained by the positioning link to include longitudinal movement; an adjusting screw connecting the adjusting lever and the housing for changing the relative position thereof and thus varying the longitudinal position of the metering rod in the orifice, the positioning link being effecting to move the lower end of the metering rod through a path constrained by the adjusting link to further vary the longitudinal position of the metering rod in the orifice.

* * * * *